US009115433B2

(12) United States Patent
Boehme et al.

(10) Patent No.: US 9,115,433 B2
(45) Date of Patent: Aug. 25, 2015

(54) METHOD FOR THE SURFACE TREATMENT OF STAINLESS STEEL

(75) Inventors: Olaf Boehme, Erding (DE); Siegfried Piesslinger-Schweiger, Vaterstetten (DE)

(73) Assignee: POLIGRAT GMBH, Munich (DE)

( * ) Notice: Subject to any disclaimer, the term of this patent is extended or adjusted under 35 U.S.C. 154(b) by 1098 days.

(21) Appl. No.: 13/126,827

(22) PCT Filed: Oct. 15, 2009

(86) PCT No.: PCT/EP2009/007402

§ 371 (c)(1),
(2), (4) Date: Jul. 18, 2011

(87) PCT Pub. No.: WO2010/049065

PCT Pub. Date: May 6, 2010

(65) Prior Publication Data

US 2011/0309296 A1 Dec. 22, 2011

(30) Foreign Application Priority Data

Oct. 29, 2008 (EP) ..... 08018874

(51) Int. Cl.

| | |
|---|---|
| ***C23G 1/08*** | (2006.01) |
| ***C23C 22/50*** | (2006.01) |
| ***C23G 1/32*** | (2006.01) |

(52) U.S. Cl.

CPC ..... *C23G 1/088* (2013.01); *C23C 22/50* (2013.01); *C23G 1/32* (2013.01)

(58) Field of Classification Search

CPC ..... C23G 1/088; C23G 1/08; C23G 1/23; C23G 1/081; C23G 1/083; C23G 1/085; C23C 22/50

USPC ..... 148/250, 259, 287, 260, 271, 274, 283; 106/14.12, 14.15, 14.13, 14.41, 14.42, 106/14.43

See application file for complete search history.

(56) References Cited

U.S. PATENT DOCUMENTS

| | | | | |
|---|---|---|---|---|
| 6,120,619 | A | 9/2000 | Goudiakas | |
| 8,430,973 | B2 * | 4/2013 | Bohme et al. | 148/287 |
| 2003/0221702 | A1 | 12/2003 | Peebles | |
| 2006/0079424 | A1 | 4/2006 | Perry | |

FOREIGN PATENT DOCUMENTS

| | | | |
|---|---|---|---|
| DE | 102007010538 | A1 | 9/2008 |
| JP | 59190374 | A1 | 10/1984 |
| WO | 9609899 | A | 4/1996 |
| WO | 9848080 | A | 10/1998 |
| WO | 0034551 | A | 6/2000 |
| WO | WO 2008107082 | A8 * | 11/2008 |

OTHER PUBLICATIONS

International Search Report for Appln. No. PCT/EP2009/007402 mailed Jan. 29, 2010.

"The Passivation of Steel", Technical Bulletin, Oct. 1, 2005, pp. 1-2.

* cited by examiner

*Primary Examiner* — Douglas McGinty

(74) *Attorney, Agent, or Firm* — Carter, DeLuca, Farrell & Schmidt, LLP

(57) ABSTRACT

In a method for surface treatment of stainless steel, the thermally produced layers of oxide are contacted with a composition effective to dissolve iron ions out of the layers of oxide.

16 Claims, No Drawings

METHOD FOR THE SURFACE TREATMENT OF STAINLESS STEEL

TECHNICAL FIELD

The present invention relates to a method for the surface treatment of stainless steel instead of pickling. In this method, scale and annealing/tempering colors in the region of welded seams and heat-treated surfaces are converted into corrosion-resistant layers of oxide. The purpose of this method is an improved corrosion resistance without metal ablation. In this method, the stainless steel surface is treated with an aqueous or pasty solution/mixture. The mixture typically comprises a combination of complexing agents and an oxidizing agent.

BACKGROUND ART

Steel which does not rust, frequently also referred to as stainless steel, is an iron alloy which in addition to iron and chromium may also contain further elements such as nickel, molybdenum, titanium, copper and others. An essential constituent of the stainless steel alloys whose treatment comprises part of the subject matter of the present invention is the element chromium which is present at a minimum concentration of about 12% by weight in order that enhanced resistance of the steel to corrosion may be ensured. The chromium present in the alloy reacts at the surface with oxygen from the surroundings to form a layer of oxide on the surface of the workpiece material. From a chromium content of about 12% by weight in the alloy of the workpiece material concerned, the chromium oxide formed is consistently able to form an impervious layer on the surface and thus protects the workpiece against corrosion. This protective layer is known as a passive layer.

Such a passive layer is generally about 10 molecular layers in thickness and, in addition to chromium oxide, contains particularly iron oxide at a concentration of 10-55% by weight. The lower the proportion of iron oxide in the passive layer, the higher the chemical resistance of the layer.

A thermal treatment of stainless steel in an oxidizing atmosphere at temperatures above 200° C. brings about a progressive thermal oxidation of the workpiece material to form an oxide layer consisting essentially of oxides of the metals present in the alloy and whose quantitative ratio between the oxides corresponds essentially to the quantitative ratio between the metals in the alloy. The thermally produced oxide layers therefore contain up to about 87% by weight of iron oxides, depending on the alloy. These oxide layers grow in thickness with increasing temperature and treatment time and lead to discolorations through to black or gray coatings. These are known as scale and annealing/tempering colors.

Oxide layers of this type, which contain distinctly more iron oxide than chromium oxide, are not resistant to corrosion, and so the stainless steel in these regions is not sufficiently corrosion-resistant for general use. In moist surroundings, the iron oxide reacts with water to form iron hydroxide and rust.

Consistent and complete removal of scale and annealing/tempering colors off stainless steel surfaces is an absolute prerequisite for the subsequent formation of an intact passive layer which is responsible for the corrosion resistance of stainless steel. In the prior art, thermal oxides are removed either by mechanical cleaning via grinding, brushing or particle blasting or by chemical or electrolytic pickling. The mechanical methods have the disadvantage that their cleaning effect is incomplete and insufficient and does not reach difficult-to-access regions such as corners, slots and cavities. And small and sensitive workpieces are easily damaged.

Electrolytic pickling utilizes aqueous mixtures of mineral acids which via agency of direct current lead to an anodic ablation of the uppermost layer of metal through electrochemical dissolution which also removes the oxide layers on top. These methods can only be applied in the case of thin layers of oxide which are pervious to direct current and electrolyte. They further require an appreciable capital investment in plant technology. They employ hazardous substances and generate wastewaters comprising heavy metal which are costly and inconvenient to treat and dispose of.

Chemical methods of pickling dissolve the oxide layers and the metal of the uppermost layer of workpiece material chemically to produce a metallically clean surface. A homogeneous passive layer can subsequently be formed on this metallically clean surface to protect the workpiece material efficaciously against corrosion. Chemical pickling allows the entire surface of workpieces to be treated, including difficult-to-access regions. What is disadvantageous is the fact that dissolving the oxides and the workpiece material requires extremely aggressive and hazardous chemicals which represent a considerable risk to humans and the environment.

Essential constituents of chemical pickles for stainless steel are hydrofluoric acid (HF) or fluorides of salts of hydrofluoric acid, which form hydrofluoric acid in aqueous solution, and also oxidizing agents such as nitric acid or hydrogen peroxide. Hydrofluoric acid is extremely poisonous in that even relatively minimal contact with the skin can be fatal. Nitric acid when used in pickling releases poisonous nitrous gases which are very harmful to the lung. Hydrofluoric acid and nitric acid are fuming acids, and so the air in the workplace environment has to be aspirated and specially treated. The personnel deployed in chemical pickling has to wear appropriate protective clothing with or without a respirator, and is subject to constant medical monitoring.

There are strict safety regulations governing the production, transportation, storage and use of the chemicals used for chemical pickling. The wastewaters generated in chemical pickling contain high concentrations of the acids in the pickle and also of the heavy metals in the alloy, such as chromium, iron, nickel and molybdenum. They require costly and inconvenient chemical treatment for disposal, and the solids generated have to be landfilled as special waste. Spent pickling solutions have to be disposed of as hazardous special waste.

Given the greatly increasing use of stainless steel in all areas of everyday life and industry, and the attendant increasing need for pickling, there is an urgent demand for a method which in terms of performance is comparable to the pickling method for stainless steel, but is harmless to humans and the environment.

The present invention provides a chemical stainless steel surface treatment method which is harmless to humans and the environment and in terms of the achievable corrosion resistance at least equivalent, but largely distinctly superior, to the prior art processes in respect of the corrosion resistance which is obtainable.

DESCRIPTION OF THE INVENTION

The methods hitherto used for pickling stainless steel are all based on the concept of ablating the existing layers of oxide including the uppermost layer of workpiece material in order that the cleaned metallic surface may then gradually form a passive layer of the desired quality by exposure to oxygen from the surroundings.

The present invention adopts a novel, hitherto unused way to solve the problem:

The invention proceeds from the idea that in principle there is no need to remove the existing thermally produced layers of oxide. Instead, it should be sufficient to reduce the concentration of iron oxides in the thermally produced layers of oxide to such an extent that the thermally produced layers of oxide end up having a concentration ratio of chromium oxides to iron oxides which at least corresponds to that of intact passive layers. To be able to remove iron oxides selectively from the thermally produced layers of oxide, it is necessary to have an agent with a greater selective chemical affinity for iron than the affinity of iron for oxygen. This makes it possible for the iron oxides to be split asunder. The iron can then be removed selectively from the thermally produced layers of oxide.

Surprisingly, an aqueous solution comprising a specific combination of organic complexing agents in association with an oxidizing agent does have these sought-after properties, for example. The method of the present invention provides selective removal of the iron from all oxidation states of iron with the exception of hematite. However, hematite is chemically sufficiently stable even under corrosive conditions, and so remaining residues of hematite have no adverse effects on the corrosion resistance of stainless steel.

The invention accordingly provides a method for surface treatment of stainless steel wherein thermally produced layers of oxide are contacted with a composition, effective to selectively dissolve iron ions out of the thermal layers of oxide.

Two kinds of prerequisites appear to be crucial for the understanding of the present invention. First, the surfaces which are treated according to the present invention are stainless steel surfaces displaying thermally produced layers of oxide. Thermally produced layers of oxide are precisely not such oxide-containing layers as typically serve to passivate the stainless steel surface. On the contrary, thermally produced layers of oxide are unwanted and troublesome layers of oxide which lead to discolorations and are themselves corrosion-susceptible and/or amplify the corrosion susceptibility of a stainless steel surface. Therefore, it is an ever present absolute requirement in the prior art that thermally produced layers of oxide be removed as part of measures to improve corrosion resistance. The present invention differs in principle from the prior art not just conceptionally but also with regard to the aqueous solution then actually employed. This is because the prior art involves a pickling, i.e., ablating, treatment of the stainless steel surface with the consequence that the thermal layers of oxide are completely removed. Such a method is described for example in commonly assigned German utility model DE 92 14 890 U1, wherein the stainless steel surfaces are treated ablatingly with a solution containing phosphoric acid and sulfuric acid until neither scale residues nor discolorations about a welded seam can be observed. The present invention, then, does not involve any pickling off and ablating. Therefore, any possible acid content in an aqueous solution according to the present invention is always determined such that no significant ablation takes place. This means for example in the case of the comparatively strong acids nitric acid/sulfuric acid/phosphoric acid that these acids can be omitted when working according to the present invention. However, minor quantities can be tolerated so long as there is no appreciable ablation of the thermally produced layers of oxide. According to the present invention, comparatively weak acids are used in comparatively low concentrations, of up to about 5% by weight in the case of citric acid for example.

Solutions useful for the purposes of the present invention are already proposed by commonly assigned DE 10 2007 010 538 A1 for a different method. That method is concerned with pretreating a stainless steel surface with an optimized aqueous passivating solution to protect it against unwanted colorations which can arise as a result of the stainless steel surface being exposed to temperatures at which thermal layers of oxide are first formed. That method thus has for its purpose to prevent precisely the thermally produced layers of oxide which are treated by the process of the present invention.

Thermally produced layers of oxide herein are scale and annealing/tempering colors of the kind that typically arise in thermal treatment or welding of stainless steels. These surface layers are generally identified by the discoloration they cause to the surface. The surface can then have a straw-yellow coloration which, depending on the duration and intensity of the thermal treatment of the surface, can even transition into brown and blue hues.

Highly alloyed steels are generally observed to give rise to the following annealing/tempering colors and layer thicknesses at annealing/tempering (elevated temperature) in the range from about 350° C. to >1200° C.:

| Color | Temperature | Layer thickness |
|---|---|---|
| chromium yellow | <400° C. | <=5 nm |
| straw yellow | >400° C. | <=25 nm |
| golden yellow | ~500° C. | 50-75 nm |
| brownish red | ~650° C. | 75-100 nm |
| cobalt blue | | 100-125 nm |
| light blue | ~1000° C. | 125-175 nm |
| colorless | | 175-275 nm |
| brownish gray | ~1200° C. | >275 nm |

The chemical composition of the solution or mixture used according to the present invention, then, is chosen such that there is not measurable depletion of the surface but that a dissolving out of the iron ions from the oxide layer at the surface does take place. So in effect the process of the present invention does resemble a pickling process, yet in contrast to prior art pickling the thermal layers of oxide are not dissolved off. Therefore, the present invention is able to utilize such mixtures as do not entail the disadvantages of the pickling baths used in the prior art.

The dissolving out of the iron ions from the surface preferably takes place selectively. "Selectively" here means that the complexing agent has greater affinity (i.e., greater complexing power) for the iron than for the other constituents in the thermal layers of oxide (chromium or nickel for example).

The solutions/mixtures of the present invention typically comprise a combination of a complexing agent for iron and an oxidizing agent. A complexing agent is typically a compound capable of complexing iron ions in aqueous solution. Useful complexing agents include in particular hydroxy carboxylic acids, phosphonic acids and also organic nitrosulfonic acids.

The preferred complexing agents are polydentate complexing agents. These polydentate complexing agents are capable of forming chelated complexes with iron ions. This makes it possible to increase the ratio of chromium oxide to iron oxide in the thermal layers of oxide.

Examples of suitable complexing agents further include hydroxy carboxylic acids having 1, 2 or 3 hydroxyl groups and 1, 2 or 3 carboxyl groups, or salts thereof. Citric acid is a particularly suitable hydroxy carboxylic acid. A further suitable complexing agent is phosphonic acid having the general formula R'—$PO(OH)_2$, where R' is a monovalent alkyl, hydroxyalkyl or aminoalkyl radical. Diphosphonic acid of the general formula R"[—$PO(OH)_2]_2$ can also be used according to the present invention, in which case R" is a divalent alkyl, hydroxyalkyl or aminoalkyl radical. Instead of or in addition to these phosphonic acids and/or diphosphonic acids, one or more salts of these phosphonic acids and diphosphonic acids, respectively, can also be used. A particularly preferred example of such an acid is 1-hydroxyethane-1,1-diphosphonic acid (HEDP) or its salt. Further suitable complexing agents are the class of organic nitrosulfonic acids, for example nitroalkylsulfonic acids, nitroarylsulfonic acids and salts thereof. meta-Nitrobenzenesulfonic acid is a particularly preferred nitroarylsulfonic acid. The substituted or unsubstituted alkyl or aryl radicals used should be chosen such that the acid or salt has sufficient solubility in the aqueous solution/mixture. Therefore, a hydrocarbon chain preferably has not more than twelve carbon atoms.

The compositions of the present invention may further comprise oxidizing agents. Suitable oxidizing agents include for example nitrates, peroxo compounds, iodates and cerium (IV) compounds in the form of the respective acids or water-soluble salts. Examples of peroxo compounds are peroxides, persulfates, perborates or else percarboxylates such as peracetate for example. Oxidizing agents can be used singly or in the form of mixtures.

The term "stainless steel" as used herein is to be understood as referring to an iron alloy that contains a considerable proportion of chromium, for example about 13% by weight or more.

The solutions/mixtures of the present invention may further comprise one or more wetting agents to reduce the surface tension of the aqueous compositions. Examples of suitable wetting agents include, for instance, the nitroalkyl- or nitroarylsulfonic acids already described in connection with complexing agents, or else alkylglycols of the general formula H—$(O—CHR—CH_2)_n$—OH, where R is hydrogen or an alkyl radical having 1, 2 or 3 carbon atoms and n is preferably an integer between 1 and 5, for example 2 or 3.

A very particularly suitable composition useful for surface treatment for the purposes of the present invention has the following composition:

- 0.5-10% by weight and more particularly 3.0-5.0% by weight of at least one hydroxy carboxylic acid having 1-3 hydroxyl and 1-3 carboxyl groups, or salt(s) thereof,
- 0.2-5.0% by weight and more particularly 0.5-3.0% by weight of at least one phosphonic acid of the general structure R'—$PO(OH)_2$ or salt(s) thereof, wherein R' is a monovalent alkyl, hydroxyalkyl or aminoalkyl radical, and/or of the general structure R"[—$PO(OH)_2]_2$ or salt (s) thereof, where R" is a divalent alkyl, hydroxyalkyl or aminoalkyl radical,
- 0.1-5.0% by weight and more particularly 0.5-3.0% by weight of at least one nitroaryl- or nitroalkylsulfonic acid or salt(s) thereof,
- 0.05-1.0% by weight and more particularly 0.1-0.5% by weight of at least one alkylglycol of the general structure H—$(O—CHR—CH_2)_n$—OH, where R is hydrogen or an alkyl radical having 1-3 carbon atoms and n is 1-5, and
- 0.2-20% by weight and more particularly 0.5-15% by weight of an oxidizing agent, the remainder of the composition being water.

These compositions may additionally include further wetting agents at a concentration between 0.02% and 2.0% by weight and preferably between 0.05% and 1.0% by weight. These compositions may optionally also contain one or more thickeners. Examples of suitable thickeners are methylcellulose and kieselguhr. Such a thickener serves to increase the viscosity of the mixture.

The method of the present invention is generally carried out at a temperature between room temperature and 95° C. However, other temperatures are also conceivable, although it must always be ensured that there is no appreciable ablation of the treated thermal layers of oxide.

The surface treatment of the present invention is typically carried out over a period of time which can lie between 0.5 and 7 hours.

Following the surface treatment, the stainless steel surface is generally rinsed with water, typically with deionized water.

The pickling process can be carried out in a dip bath or by spraying, trickling or wiping a liquid onto the surfaces to be cleaned or applying thereto a spreadable paste, lightly thickened with a suitable thickening agent (methylcellulose).

Application temperature in the dip bath is preferably in the range from 50° C. to 95° C. and preferably in the range from 50° C. to 70° C. Treatment time is in the range from 3 to 5 hours depending on the degree of scaling, the alloy to be treated and the temperature used. At comparatively low temperatures, the treatment time can be comparatively long. Temperatures below 50° C. are only used in the case of applications outside the bath. The temperature of the dip baths should be at least 50° C. on a sustained basis in order to avoid any biodegradation of the bath liquid.

The present invention thus also provides for the use of a composition which contains a complexing agent for iron and is essentially free of hydrofluoric acid or fluoride ions, and also other halide ions and mineral acids, for surface treatment of a workpiece of stainless steel, wherein this surface includes thermally produced layers of oxide.

With regard to the complexing agent, the further constituents of the composition and the procedure involved in the surface treatment, the prerequisites and features established and indicated above for the method apply.

The statement "essentially free of hydrofluoric acid and/or fluoride ions" is to be understood as meaning that the composition for example does not contain hydrofluoric acid in a proportion as present in conventional pickling agents. But preferably the composition is completely free of hydrofluoric acid. Typically, the composition virtually does also not contain any mineral acids.

EXAMPLES

Example 1

Six 1 mm thick stainless steel panels of the grade 1.4301 (AISI 304) having a cold-rolled surface were cut out of a panel and then welded together pairwise to form three specimens (A, B and C). The specimens were subsequently alkali degreased, rinsed with deionized water and dried.

Specimen A was left untreated.

Specimen B was dipped for 3 hours at room temperature into a pickling solution consisting of 5% by weight of hydrochloric acid and 15% by weight of nitric acid, balance water, then rinsed off with deionized water and dipped for 30 minutes at room temperature into a passivating solution consisting of 20% by weight of nitric acid, balance water. Finally, the specimen was rinsed with deionized water and dried.

Specimen C was dipped into a solution consisting of 3.3% of citric acid
2.1% of nitroalkylsulfonic acid
3.5% of hydroxyethanediphosphonic acid
0.2% of ethylene glycol 0.1% of wetting agent 25% of magnesium nitrate.6 H2O balance deionized water at 70° C. for 3 hours, then rinsed with deionized water and dried.

The specimens A, B and C were subsequently subjected to a potentiodynamic measurement, in millivolts, of their pitting potential against an Ag/AgCl electrode in artificial seawater containing 20 000 ppm of chloride. The measurement was carried out in three places—in the blank region, not heat influenced; in the region of the heat influence zone; and in the region of the welded seam. The results are shown in Table 1.

TABLE 1

Pitting potential of workpiece material 1.4301

| Specimen | Unaffected region | Heat influence zone | Welded seam region |
|---|---|---|---|
| A | 370 | 280 | 150 |
| B | 350 | 320 | 340 |
| C | 500 | 400 | 350 |

Example 2

Six 1.2 mm thick stainless steel panels of the grade 1.4571 (AISI 316 TI) having a cold-rolled surface were cut out of a panel and then welded together pairwise to form three specimens (D, E and F). The specimens were subsequently alkali degreased, rinsed with deionized water and dried.

Specimen D was left untreated.

Specimen E was treated like specimen B.

Specimen F was treated like specimen C.

Specimens D, E and F were subsequently subjected to measurement of pitting potential as described in Example 1, in the blank region not heat influenced, in the heat influence zone and at the welded seam. The results are shown in Table 2.

TABLE 2

Pitting potential of workpiece material 1.4571

| Specimen | Unaffected region | Heat influence zone | Welded seam region |
|---|---|---|---|
| D | 480 | 400 | 400 |
| E | 520 | 550 | 550 |
| F | 700 | 650 | 630 |

The two examples show that the pitting potentials achieved on the treated surfaces by the method of the present invention (specimens C and F) are the same as or higher than for the prior art pickling process (specimens B and E).

The method of the present invention has a number of significant advantages over the pickling processes representing the prior art:

The chemicals used are not hazardous materials. Production, transportation, storage and use are not subject to any restrictions or special precautions. The process of the present invention can be practiced everywhere and does not require special protective measures for humans and the environment.

The chemicals used are biodegradable and like the rinse waters generated require no special cost or inconvenience to dispose of.

The chemicals used do not adversely impact the air as gases or odors.

The method of the present invention selectively dissolves iron exclusively out of the already existing thermal layer of oxide. Chromium, nickel, molybdenum and other heavy metals and also the metal of the workpiece surface are generally not dissolved out and released. They accordingly do not pass into the bath chemicals and into the rinse water. The amount of iron dissolved out of the existing layer of oxide is so low that the statutory limits for iron in rinse water are not reached by a long way. The rinse water therefore requires no special treatment and there are no generated solid, heavy metal-containing noxiants to dispose of.

The amount of dissolved iron is too low for bath exhaustion due to metal accumulation. Replenishing the chemicals adhering to and dragged out by the treated surfaces by fresh chemicals maintains the iron concentration in the bath at distinctly below 10% of the critical concentration. Recovering the chemicals via evaporation with recycling of the rinse water is readily possible.

The method of the present invention does not cause the metal of the workpiece surface to become attacked, which is why the treatment does not have any adverse effect on surface appearance and quality.

Since the existing layer of oxide is not ablated, full corrosion resistance of the stainless steel is ensured immediately after the treatment without any need for an additional passivating treatment or delay time to form a new passive layer. Corrosion resistance is immediately ensured irrespective of the availability of oxygen from the environment.

The invention claimed is:

1. A method for treating a surface of stainless steel which includes thermally produced layers of oxide, the method comprising:

contacting the thermally produced layers of oxide identified by a discoloration on the surface, with a composition including a complexing agent and an oxidizing agent, the composition being effective to selectively dissolve iron ions out of the thermally produced layers of oxide, wherein no appreciable ablation of the surface results, and wherein full corrosion resistance of the stainless steel is attained immediately after treatment and without requiring any additional passivating treatment or delay time to form new passive layers on the stainless steel.

2. The method according to claim 1, wherein the composition comprises:

at least one hydroxy carboxylic acid having 1-3 hydroxyl and 1-3 carboxyl groups, or salt(s) thereof;

at least one phosphonic acid of the general structure R'—$PO(OH)_2$ or salt(s) thereof, wherein R' is a monovalent alkyl, hydroxyalkyl or aminoalkyl radical, and/or of the general structure R"[—$PO(OH)_2]_2$ or salt(s) thereof, where R" is a bivalent alkyl, hydroxyalkyl or aminoalkyl radical; and at least one nitroaryl- or nitroalkylsulfonic acid or salt(s) thereof.

3. The method according to claim 1, wherein the oxidizing agent comprises at least one compound selected from the group consisting of nitrates, peroxides, persulfates, perborates, percarboxylates, and iodate and cerium(IV) compounds, in the form of the respective acids and/or salts.

4. The method according to claim 1, wherein the composition comprises:

0.5-10% by weight of at least one hydroxy carboxylic acid having 1-3 hydroxyl and 1-3 carboxyl groups, or salt(s) thereof;

0.2-5.0% by weight of at least one phosphonic acid of the general structure R'—$PO(OH)_2$ or salt(s) thereof, wherein R' is a monovalent alkyl, hydroxyalkyl or aminoalkyl radical, and/or of the general structure R"[—$PO(OH)_2]_2$ or salt(s) thereof, where R" is a divalent alkyl, hydroxyalkyl or aminoalkyl radical;

0.1-5.0% by weight of at least one nitroaryl- or nitroalkylsulfonic acid or salt(s) thereof;

0.05-1.0% by weight of at least one alkylglycol of the general structure H—$(O—CHR—CH_2)_n$—OH, where R is hydrogen or an alkyl radical having 1-3 carbon atoms and n is 1-5; and 0.2-20% by weight of an oxidizing agent, wherein the remainder of the solution is water which, optionally includes, one or more thickeners.

5. The method according to claim 1, wherein the contacting takes place in a temperature range between room temperature and 95° C.

6. The method according to claim 1, wherein the complexing agent is selected from the group consisting of hydroxy carboxylic acids, phosphonic acids, nitrosulfonic acids, salts thereof, and combinations thereof.

7. The method according to claim 6, wherein the hydroxy carboxylic acid is citric acid, the phosphonic acid is 1-hydroxyethane-1,1-diphosphonic acid, and the nitrosulfonic acid is meta-nitrobenzenesulfonic acid.

8. The method according to claim 1, wherein the complexing agent is a polydentate chelating agent.

9. The method according to claim 4, wherein the hydroxy carboxylic acid is citric acid, the phosphonic acid is 1-hydroxyethane-1,1-diphosphonic acid, the nitrosulfonic acid is meta-nitrobenzenesulfonic acid.

10. The method according to claim 1, wherein the composition further comprises a wetting agent, wherein the wetting agent is selected from the group consisting of nitrosulfonic acids and salts thereof, alkylglycols, and combinations thereof.

11. The method according to claim 1, wherein the contacting is carried out over a period of time from about 0.5 hours to about 7 hours.

12. The method according to claim 1, wherein the contacting is carried out via a method selected from the group consisting of dip bath, spraying, trickling, wiping, and combinations thereof.

13. The method according to claim 1, wherein the composition further comprises a thickening agent and is in the form of a spreadable paste.

14. The method according to claim 1, wherein a pitting potential of the stainless steel is increased from about 120 mV to about 250 mV after treatment.

15. The method according to claim 1, wherein the thermally produced layers of oxide include scale and annealing/tempering colors that arise in thermal treatment or welding of stainless steel.

16. A method for treating a surface of stainless steel which includes thermally produced layers of oxide, the method consisting essentially of:

contacting the thermally produced layers of oxide identified by a discoloration on the surface, with a composition including a complexing agent and an oxidizing agent, the composition being effective to selectively dissolve iron ions out of the thermally produced layers of oxide, wherein no appreciable ablation of the surface results, and wherein full corrosion resistance of the stainless steel is attained immediately after treatment and without requiring any additional passivating treatment or delay time to form new passive layers on the stainless steel.

* * * * *